US006887424B2

(12) United States Patent
Ohno et al.

(10) Patent No.: US 6,887,424 B2
(45) Date of Patent: May 3, 2005

(54) INLINE DEGASSING APPARATUS

(75) Inventors: Yoshikazu Ohno, Kobe (JP); Shunji Mochizuki, Amagasaki (JP)

(73) Assignees: Pyrotek Japan Limited, Kobe (JP); Tounetsu Kabushikikaisha, Amagasaki (JP)

( * ) Notice: Subject to any disclaimer, the term of this patent is extended or adjusted under 35 U.S.C. 154(b) by 22 days.

(21) Appl. No.: 10/365,443

(22) Filed: Feb. 13, 2003

(65) Prior Publication Data

US 2003/0151176 A1 Aug. 14, 2003

(30) Foreign Application Priority Data

Feb. 14, 2002 (JP) ..... 2002-079703

(51) Int. Cl.[7] ..... C21C 7/00
(52) U.S. Cl. ..... 266/217; 75/680
(58) Field of Search ..... 266/217; 75/680

(56) References Cited

U.S. PATENT DOCUMENTS 4,203,581 A * 5/1980 Pelton ..... 266/217
4,373,704 A * 2/1983 Pelton ..... 75/680
5,494,265 A * 2/1996 Ventre ..... 266/217
5,968,223 A * 10/1999 Eckert ..... 75/680

* cited by examiner

*Primary Examiner*—Scott Kastler
(74) *Attorney, Agent, or Firm*—Oblon, Spivak, McClelland, Maier & Neustadt, P.C.

(57) ABSTRACT

An inline degassing apparatus for removing solid solution gases as well as nonmetallic inclusions from molten metal in a degassing container, to which the molten metal is continuously introduced for degassing operation and from which the degassed molten metal is continuously removed. A rotary diffusing device is arranged in the degassing container for generating bubbles of inert gas diffused into the molten metal, thereby entrapping solid solution gases as well as nonmetallic inclusions into the bubbles, which are then floated and separated. Heaters are provided, which extend, in a cantilever fashion, from a side wall of container at a position adjacent the bottom wall of the container substantially parallel to the bottom wall.

10 Claims, 4 Drawing Sheets

INLINE DEGASSING APPARATUS

BACKGROUND OF THE INVENTION

1. Field of the Invention

The present invention relates to an inline degassing apparatus used for continuous degassing of nonferrous metal such as aluminum alloys and magnesium alloys.

2. Description of Related Art

During refining process of nonferrous metals such as aluminum alloys and magnesium alloys, a situation is frequently occurred that nonmetallic inclusions such as oxides are generated and hydrogen gas is mixed with the molten metal. Accordingly, a high quality after processing or working can only be achieved when a separating or removal of nonmetallic inclusions from the molten metal is done prior to the processing or working. Furthermore, by an introduction of molten metal containing solid dissolved gases including mainly hydrogen gas into a mold, small cavities called "pinholes" are likely generated after the solidification, resulting in a reduction in a degree of the compactness of the finished products. Furthermore, the existence of the inclusions attached to the gases may generate various defects in the product after subjected to a processing or working.

In view of the above, during the execution of a casting process of nonferrous metal such as aluminum alloy or magnesium alloy, a molten material is subjected to a degassing operation for increasing a quality of the molten metal prior to the execution of a casting operation. In such a degassing operation, a large quantity of finely bubbled inert gas such as argon gas or nitrogen gas is blown into the molten metal, so that solid dissolved gas and nonmetallic inclusions are entrapped or caught by the bubbles of the inert gas, which are floated for the removal.

FIG. 1 schematically illustrates a conventional structure of a degassing apparatus, which has been used for a continuous casting. The apparatus is placed between a holding furnace and a casting machine along a molten metal treatment line. The degassing apparatus receives molten metal 9 continuously through an inlet 2. The upper opening of a degassing container 1 is covered by a lid 3 and, at the downstream side, a partition 4 extends downwardly in the direction so that it crosses the flow of the metal 9 for preventing floating substances (suspended matter) including oxides etc., which is called as dross, from being flown into the subsequent treatment process. Namely, the partition 4 extends downwardly, so that a relatively narrowed passageway of a predetermined flow area is formed between the bottom end of the partition 4 and the inner bottom wall of the container 1. Such an arrangement of the partition 4 can obtain a maximized residence time of molten metal at the treating chamber 8 upstream from the partition 4, so that a prolonged duration of time of a degassing operation can be achieved. A rotary gas-diffusing device 5 is inserted through an aperture made in the lid 3 and is located in the molten metal in the degassing container 1. The gas-diffusing device 5 has a lower part located (immersed) in the molten metal while being subjected to a rotating movement, so that the inert gas is ejected from the lower part of the gas-diffusing device 5, while a finely bubbled inert gas is diffused into the molten metal.

A diffusion of an inert gas from the gas diffusing device 5 may cause a temperature the molten metal 9 to be dropped. Thus, it is quite likely that desired casting temperature cannot be maintained and in the worst case a solidification of the molten metal may be commenced. As a countermeasure, the degassing container 1 is provided with the burner 6 for generating a flame, which is directed through the aperture made in the lid 3 toward the molten metal in the container to keep the constant temperature.

Apart from the matter of degassing as discussed above, the burner 6 for heating of the metal in the container is also required to cause the metal remained in the container to be heated. Otherwise, a solidification of the metal remained in the container is started, which make it difficult that the metal remained in the container is smoothly molten together with the newly introduced metal into the container. Furthermore, when maintenance work is necessary in the degassing container, an operation of the burner 6 is essential for removing the molten metal remained in the container.

However, the aforementioned burner 6 heats the molten metal 9 from the upper side and, therefore, a difficulty is inevitably encountered that a heat cannot be easy reached to the molten metal in the lower position of the degassing container 1. In addition, this system is disadvantageous in that the flame of the burner promotes oxidation of the molten metal and an increased amount of the dross is generated.

To avoid such a problem, a patent convention treaty (PCT) publication WO95/13402 discloses an immersion type heater. This immersion type heater is inserted into the container through an aperture made in the lid of the container and its lower heating section is immersed or located in molten metal. Suppose as a construction of '402 patent that, instead of the burner shown 6 in FIG. 4, a longitudinally elongated cylindrical heater is arranged vertically along with sidewall of the container. The immersion type heater of '402 patent has an advantage that molten metal temperature goes up rapidly because, in comparison with the aforementioned burner heating system in FIG. 1, heat convection occurs easily owing to heating from the bottom.

The immersion type heater of '402 patent produces less amount of the dross compared with the burner heating system in FIG. 4. However, an amount of the dross, which is at any means not small amount, is still generated, which is largely attached to the portion of the heater corresponding to a location around the liquid-gas boundary in the container. By such an attachment of the dross, a removal of the heater through the heater insertion aperture at the rid becomes to be difficult. In such a situation, the heater together with the rid must be lifted, which is followed by a removal of the dross attached to the heater by scraping it. However, such a removal of the dross causes the heater to be instantly subjected to an outside air of low temperature, resulting in a rapid drop in a local temperature at a portion of the heater corresponding to a location around the liquid-gas boundary in the container. As a result, a highly increased thermal stress is generated in the heater, which frequently causes an outer protection tube to be damaged, which is made of relatively expensive ceramic material. In addition, '402 patent is also disadvantageous in an increased labor cost, which is needed for scraping the dross.

Furthermore, in '402 patent, an increased pressure is generated in the surface of the heater protection tube due to a swirl movement of the molten metal as generated by the diffusing operation of the rotary gas-diffusing device. Thus, a damage is likely generated not only in the heater protection tube but also in the heater assembly itself.

Furthermore, in case of the degassing apparatus of the '402 patent, the immersion type heater is arranged vertically close to the sidewall of the container. This is essential in the structure of the '402, in which the rotary gas-diffusing device occupies a substantial entire region of the center part of the available space inside the degassing apparatus. In this structure, the heater protection tube is inevitably subjected to great stress due to the swirl movement of the molten metal as generated by the operation of the rotary gas-diffusing device, resulting in a shortened service life of the heater protection tube, which makes the maintenance cost to be expensive. Furthermore, a non-uniformity in the temperature inside the apparatus is likely generated, which is disadvantageous not only from the view point of temperature control precision but also from the view point of thermal efficiency.

SUMMARY OF THE INVENTION

An object of the present invention is to provide a novel structure of an inline degassing apparatus capable of overcoming various problems encountered in the prior arts.

Another object of the present invention is to provide an inline degassing apparatus capable of reducing an amount of dross attached to a heater.

A still another object of the present invention is to provide an inline degassing apparatus capable of prolonging a service life of a degassing apparatus, especially, its heater.

A further object of the present invention is to provide an inline degassing apparatus capable of obtaining an increased precision in a temperature control capability.

A further another object of the present invention is to provide an inline degassing apparatus capable of obtaining an increased thermal efficiency.

According to the present invention, an inline degassing apparatus for a continuous flow of nonferrous molten metal is provided, said apparatus comprising an inline degassing container having a side wall and a bottom wall for defining a chamber for storing therein nonferrous molten metal, an inlet on one side of the container for receiving said continuous flow of the nonferrous molten metal into said container for a degassing treatment of the material in the container, an outlet on the other side of the container for discharging the continuous degassed flow of the nonferrous molten material from the container, a rotary gas diffusing device for inert gas in the container, the rotating movement of the rotary gas diffusing device generating bubbles of inert gas diffused into the nonferrous molten metal stored in the container for removing continuously solid solution gas or nonmetallic inclusions from the nonferrous molten material in the containers, and at least one heater extending from said side wall of said container at a location adjacent the bottom wall substantially parallel with respect to said bottom wall of the container, said at least one heater being substantially entirely located in the molten metal stored in said container.

In this structure, the heater(s) is substantially entirely prevented from being contacted with the air. Thus, any dross building up on the surface of the heater does not substantially occur. Furthermore, due to the heater(s) entirely located (immersed) in the molten metal in the treatment container, the convection of heat from the heater(s) is effectively generated in the container, resulting in an increased thermal efficiency. Furthermore, due to the substantially horizontal arrangement of the heater, a pressure of the molten material applied to the surface of the heater is equalized, on one hand and, on the other hand, a thermal load on the heater is equalized. As a result, a total reduction in the thermal load is obtained, which is effective for obtaining a prolonged service life of the heater(s).

In the present invention, it is advantageous that the apparatus further comprises a plurality of baffle plates extending substantially vertically along an inner surface of said side wall of said degassing container.

By this arrangement of the baffle plates, a moderation is obtained as to the strength of the swirl movement of the molten metal in the container as generated by the rotating movement of the rotary diffusing device. By such a moderation in the swirl movement of the molten metal, the stress in the heater(s) located in the flow of the molten metal in the container is reduced, resulting in a reduction in a possible damage as generated in the heater(s) on one hand, and, on the other hand, an increase in a service life of the heater(s) is obtained. The uniformed pressure on the surface of the heater due to the horizontal arrangement of the heater is cooperated with the restriction of the swirl movement by the provision of the baffle plates, so that a highly prolonged service life of the heater is obtained, when compared with a conventional immersion type heater.

In the present invention, it is advantageous that said at least one heater extends in a cantilever fashion from a first portion of the side wall toward a second portion of the side wall opposite the first portion, and said at least one heater has a free end spaced from the opposite inner wall of the side wall of the container at a distance greater than a predetermined value.

In this structure, a separation or a distance of the heater(s) from the inner surface of the degassing container greater than a predetermined value is obtained except at a location of the container where the heater is supported. As a result, the heater is prevented from being contacted with the inner surface of the container even at a thermal expansion of the heater as generated by the heat of the heater itself, which would otherwise cause the heater to be damaged. Furthermore, such a cantilever fashioned supporting structure of the heater to the side wall of the container can reduce the number of locations of the heater where the latter is to be supported to the container. Thus, a number of parts can be reduced as far as those for preventing leakage of molten metal from the degassing container are concerned. Furthermore, the cantilever fashioned supporting structure of the heater according to the present invention is advantageous in that a stress as generated by a thermal expansion is reduced due to the freed structure at the end portion of the heater.

In the present invention, it is advantageous that said side wall of the container at said second portion is formed with an outwardly recessed portion for obtaining an increase in the volume of the container at a vertical location corresponding to a supported height of said heater to the side wall of the container.

In this structure, the contact of the heater(s) with the container lining can be avoided, on one hand, and, on the other hand, relatively small volume degassing container can be obtained while keeping the degassing capacity unchanged.

BRIEF EXPLANATION OF ATTACHED DRAWINGS

DETAILED EXPLANATION OF PREFERRED EMBODIMENT

Figure 1:
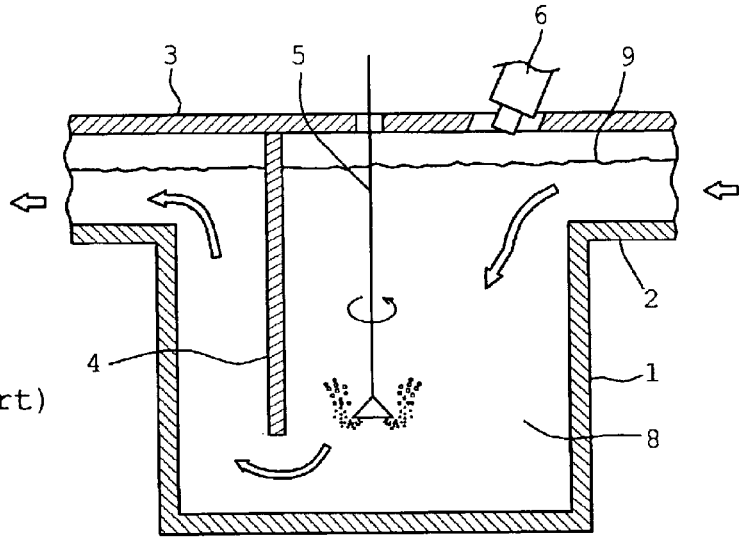
Fig.1 (Prior Art)
FIG. 1 is a schematic view of a conventional type of inline degassing.
Figure 2:
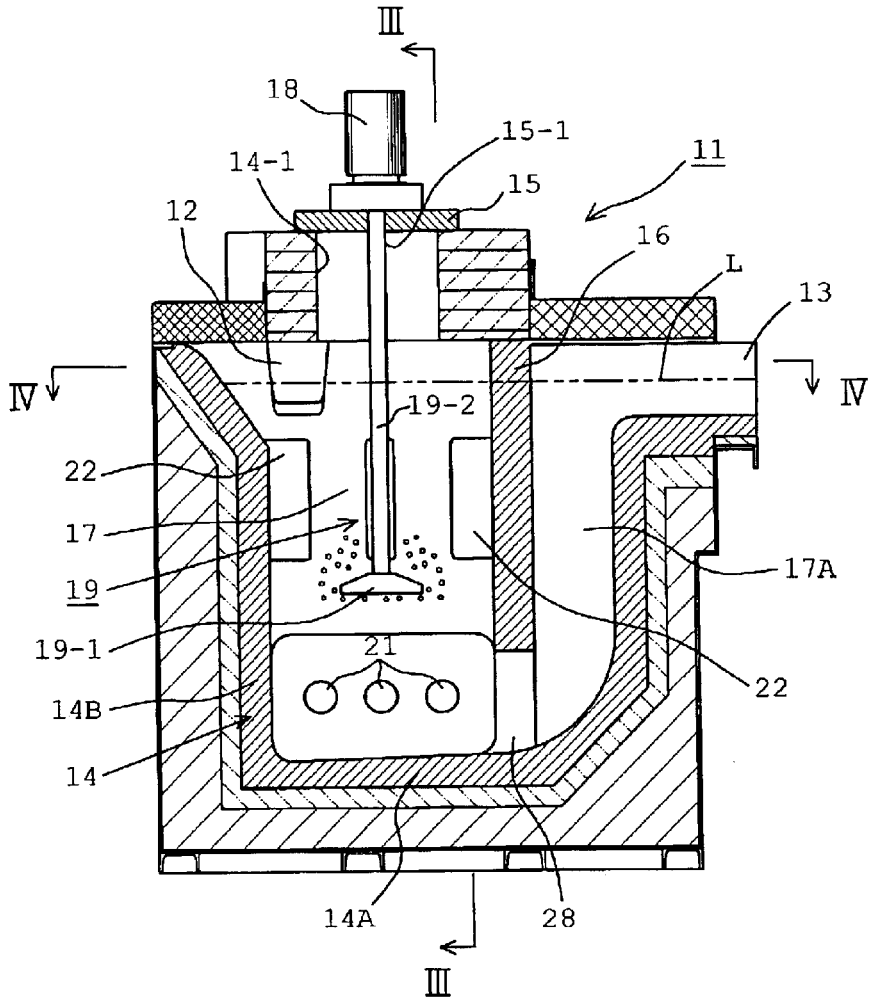
FIG. 2 is a vertical cross-sectional view of an embodiment of an inline-degassing apparatus according to the present invention.
Figure 3:
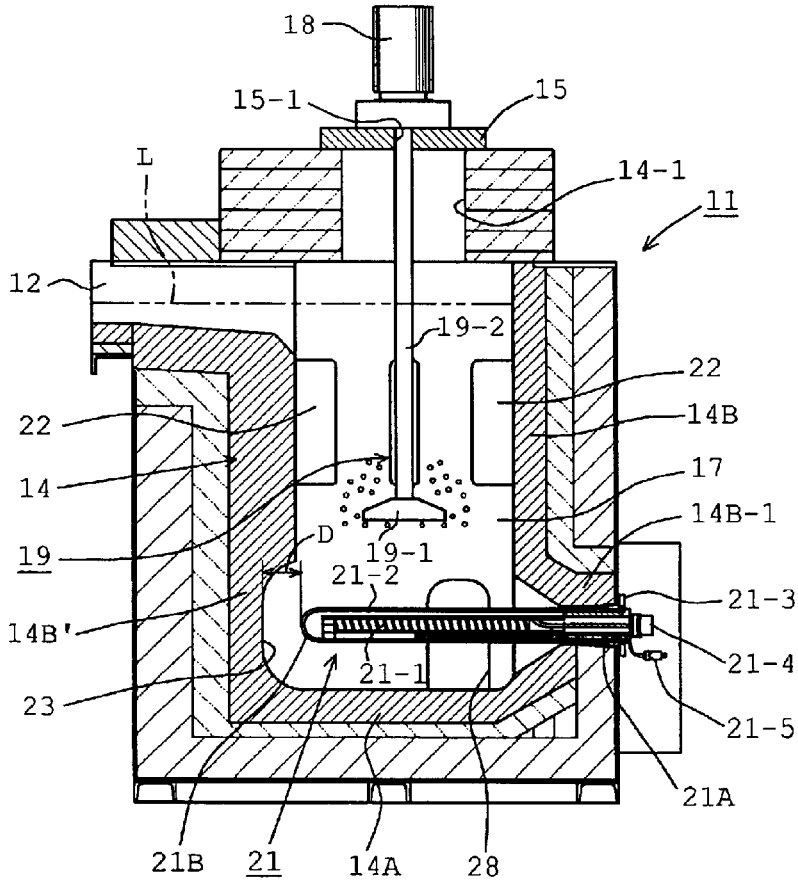
FIG. 3 is a view taken along a line III—III in FIG. 2.
Figure 4:
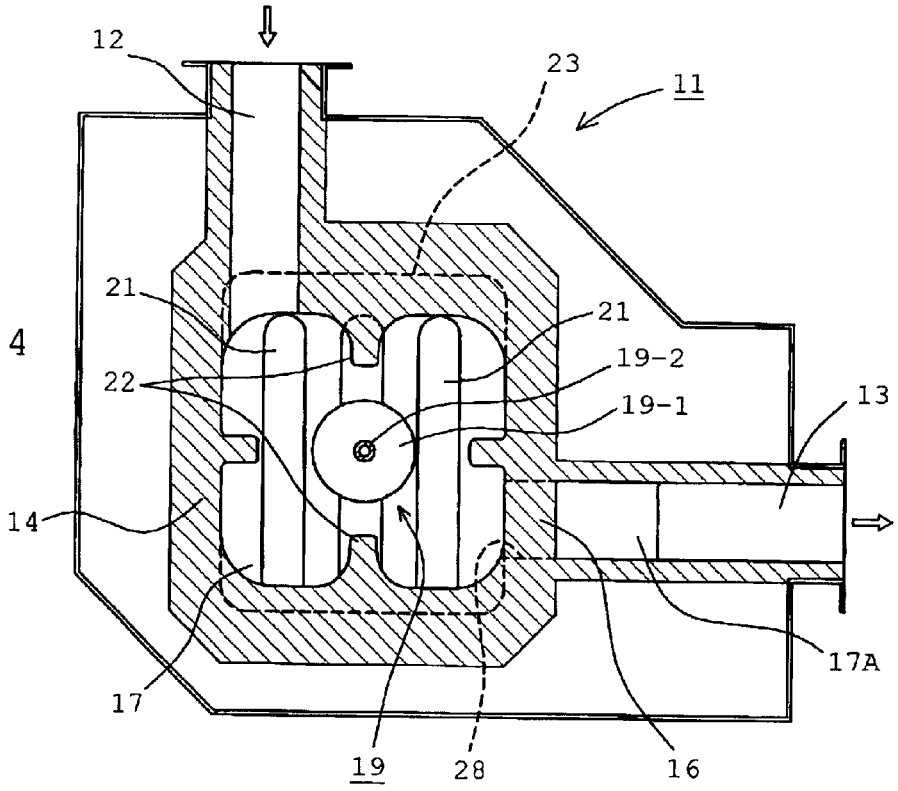
FIG. 4 is a view taken along a line IV—IV in FIG. 2.

In FIGS. 2 to 4, a reference numeral 11 denotes a inline degassing apparatus 11, which includes a degassing container 14 having the inlet 12 receiving molten metal continuously flowing from the preceding process and the outlet 13 discharging molten metal to the following process after the completion of the degassing to the subsequent process. The container 14 includes an upper opening 14-1, which is covered by a lid 15. The container 14 is further provided with a partition wall 16, which is located under the lid 15. The partition wall 16 extends vertically downwardly, so that a space inside the container 14 is divided into an upstream chamber (degassing chamber) 17, to which the inlet 12 is opened and a downstream chamber 17A, to which the outlet 13 is opened. The partition wall 16 extends to a position spaced from a bottom wall 14A of the container 14, so that a relatively narrowed passageway 28 is created for connecting the chambers 17 and 17A with each other.

A reference numeral 19 denotes a rotary gas-diffusing device for generating bubbles of inert gas diffused into the molten metal in the container 14. The rotary gas-diffusing device 19, which is per-se known, includes a diffusing head 19-1 and a rotating shaft 19-2, which is inserted into the container through the aperture 15-1 of the lid 15. The rotating shaft 19-2 has a bottom end connected to the diffusing head 19-1 located (immersed) in the molten metal in the container 14 and a top end connected to a rotating motor 18 for generating a rotating movement of the diffusing head 19-1. As a well known structure, the degassing head 19-1 is formed with a central bore, which is, via a passageway in the shaft 19-2, in communication with an inert gas source (not shown) outside the apparatus 11. The degassing head 19-1 is further provided with radial grooves (not shown) at the bottom surface of the head 19-1 in communication with the central bore of the degassing head 19-1 for discharging the inert gas from the source to the molten metal. The rotating movement of the head 19-1 causes the discharged inert gas to be finely broken so that bubbles of inert gas are created which are evenly diffused into the molten metal in the chamber 15, to which bubbles solid solution gases as well as non-metallic inclusions are entrapped or caught and are floated to a liquid-air boundary L for removal.

Heaters 21 are arranged also in the degassing container 14 for heating the molten metal. Although three heaters 21 are shown in the drawing, the present invention has no intention to limit the number of the heaters. Namely, a single heater arrangement is also possible. Each of the heaters 21 has a first end 21A connected to a side wall 14B of the container 14 at a location 14B-1 adjacent the bottom wall 14A of the container 14 and extends substantially horizontally with respect to the bottom wall 14A of the container 14 and has a second end (free end) 21B, which is spaced from a opposed portion 14B' of the side wall 14B of the container 14. As shown in FIGS. 2 and 3, the portions of the heaters 21 extending from the side wall 14B are located under the diffusion head 19-1. Thus, this arrangement of the heater 21 according to the present invention is the one, which is called as an "under heater" type.

A reference numeral 22 denotes a baffle plate, which is an integral part of the inner wall of the treating chamber 17. In this embodiment, a plurality of such baffle plates 22 is provided, which extend vertically. As shown in FIG. 4, four baffle plates 22 of a circumferential spacing of 90 degree are arranged coaxially with respect to the shaft portion 19-2 of the gas-diffusing device 19.

As shown in FIG. 3, at the portion 14B' of the side wall of the container 14, the inner surface is recessed. Such recessed portion 23 can increases volume of the container 14 at the location where the heaters 21 are arranged while keeping the size of the container 14 unchanged.

According to the embodiment as illustrated above, the heater(s) 21 is of an electrically heated type. Namely, each heater 21 is formed as a cylindrical general shape of a diameter of about 90 mm and is constructed by an electric core wire 21-1 and by a protection tube 21-2 made of a material of an increased thermal conductivity and of an increased ant-corrosive property with respect to the molten metal, such as one selected from certain fine ceramics. A suitable fitting element 21-3, which is per-se known, is provided for obtaining a sealing connection of the heater 21 to the portion 14B-1 of the side wall of the container 14. Furthermore, a suitable electric connector 21-4 for the heater 21-1 and a suitable electric connector 21-5 for a sensor for sensing the temperature of the molten metal in the container are provided. The heater 21 is arranged parallel to the container bottom inner wall 14A in the state that they are isolated at the prescribed distance from the floor 14A of the degassing container 14. Although it is desirable that the heaters 21 are positioned with respect to the bottom wall 14A as close as possible for obtaining an increased heating efficiency. A desired value of the distance of the heaters 21 from the bottom wall 14A of the container is in a range of 50–100 mm therefrom to avoid accidental contact of the heater with the floor as generated under various situations. According to the present invention, plurality of the heaters 21 may be arranged at different values of height from the bottom wall 14A. A single heater is maybe used if the heating capacity is ensured, but it is preferable to arrange a plurality of the heaters under a spaced relationship because a increased uniformity in the degree of heating of the molten metal can be obtained. As explained above, the heaters 21 extend, under a cantilever fashion, from the side wall 14B of the degassing container 14 and their free ends 21B are arranged spaced at a distance D from the opposed portion 14B' of the side wall, which distance is in a range of 50–100 mm.

According to the embodiment as explained above, the heaters 21 extend in a cantilever fashion from the lower part 14B-1 of the side wall of the container 14. However, such an arrangement of the heater 21 does not cause the volume of the treating chamber 17 to be reduced at the bottom part thereof, due to the fact the inner surface of the side opposite the free ends 21B of the heaters 21 are recessed at the location 23. Namely, the provision of the recess 23 can increase correspondingly the volume of the chamber 17, which is enough to compensate a reduction in volume as occurred by the provision of the electric heaters at the location the corresponding height of the heaters 21. As a result, a relatively small size of the degassing container 14 is maintained while avoiding contact of the heaters with the internal surface of the degassing container as mentioned above.

Additionally, according to the present invention, the baffle plates 22 extending vertically on the internal sidewall of the degassing container 14 are formed, which baffle plates 22 function to moderate or restrict the swirl movement of the molten metal as generated by the rotating movement of the rotary gas-diffusing device 19. Namely, an increased rotating speed of the swirl movement would cause a highly increased stress to be acted on the heaters 21 located just below the diffusing head 19-1, resulting in a damage or a shortened service life of the heaters 21. Contrary to this, the provision of the baffle plates 22 arranged around the gas-diffusing device 19 according to the invention can reduce the speed of the swirl movement of the molten metal in the container 14 as generated by the rotating movement of the gas-diffusing device 19. Thus, baffle plates 22 effectively function to prevent the heaters 21 from being prematurely damaged.

Furthermore, the effect of the provision of the baffle plates 22 for reducing the speed of the swirl movement is not limited to the protection of the heaters 21 as discussed above. Namely, as the specific gravity of inclusions in molten metal such as aluminum alloys is generally close to the specific gravity of molten metal, it would be usually difficult to separate inclusions so long as the strength of the swirl movement is kept. Namely, under the strong swirl movement of the molten metal, inclusions is caught in the strong flow of the molten metal and cannot easily be floated to the surface. On the contrary, the existence of baffle plates 22 according to the present invention creates turbulences at locations entirely across the degassing container 14, which makes inclusion to be floated easily, resulting in a quick separation of inclusions from molten metal. Furthermore, by an increased number of the baffle plates 22, a corresponding increase in the baffling effect can be obtained. Finally, although the baffle plates 22 are desirably arranged above the heaters 21, a length of the baffle plates is a matter of design choice so long as an installation of the heaters 21 into the container is not hindered.

Now, a manner of operation of the inline degassing apparatus according the embodiment of the present invention will be briefly explained. The molten metal from a melting furnace in the preceding process is introduced, through the inlet 12, into the degassing container 14. The molten aluminum alloy as an example of the molten metal has a temperature usually Bin a range of 680–730° C. when the molten metal is introduced into the degassing container 14. The temperature of the molten material in this range is maintained throughout the execution of the degassing operation in the degassing container 14. Simultaneously, an injection of the inert gas from the gas-diffusing head 19-1 to the molten metal is done, while the gas-diffusing head 19-1 connected to the rotating motor 18 is subjected to a rotating movement in a range of speed of 500–1000 rpm, so that the ejected inert gas is finely broken to bubbles diffused entirely into the molten metal in the container 14. Solid dissolved gases as well as suspended non-metallic inclusions in the molten metal are entrapped and caught by the bubbles, which are floated to the liquid-air boundary L, thereby achieving the degassing processing.

The provision of the baffle plates 22 around the gas-diffusing device 19 functions to oppose the swirl movement of the molten metal as generated by the rotating movement of the rotating head 19-1, so that turbulences are generated in the molten metal in the entire part of the degassing container 14, thereby promoting liquid-vapor chemical reaction.

Finally, after the completion of the degassing in the treatment chamber 17, the molten metal is passed through the passageway 28 below the partition wall 16 and is, via the downstream chamber 17A, discharged from the outlet 13 for the treatment of the molten metal at the subsequent process.

Advantageous Effect of the Invention

As explained fully in the above, due to the arrangement of the heaters 21 at the lower portion of the degassing container in a manner that the heaters 21 are substantially entirely immersed in or contacted with the molten metal, an dross build-up onto the heaters 21 can be greatly reduced, resulting in a reduction in a chance of damage to the heaters 21.

Furthermore, due to the cantilever fashioned and substantially horizontal arrangement of the heater 21 according to the present invention, an increased degree of uniformity in the pressure applied from the molten metal to the surface of the heater is obtained, on one hand, and, on the other hand, a un-uniformity of the temperature of the degassing apparatus is avoided, resulting in an increase in a thermal efficiency.

Furthermore, due to the provision of a plurality of the baffle plates 22 extending vertically on the side wall 14B of the degassing container 14, a moderation of the swirl movement of the molten material is realized, so that a pressure applied to the heaters 21 is reduced, thereby prolonging service lives of the heater protecting tube and the heater assembly itself. Furthermore, the baffle plates 22 function to generate turbulences in the molten metal, thereby speeding up the separation of the solid dissolved gases as well as inclusions from the molten metal, thereby enhancing a performance of the degassing operation.

Finally, according to the present invention, the cantilever fashioned heater at the bottom of the container is combined with the arrangement of the baffle plates above the heater, thereby providing a unique structure of degassing apparatus of an increased service life as well as an increased efficiency.

What is claimed is:

1. An inline degassing apparatus for a continuous flow of nonferrous molten metal, said apparatus comprising:

an inline degassing container having a side wall and a bottom wall for defining a chamber for storing therein nonferrous molten metal;

an inlet provided on one side of the container for receiving said continuous flow of the nonferrous molten metal into said container for a degassing treatment of the material in the container;

an outlet provided on the other side of the container for discharging the continuous degassed flow of the nonferrous molten material from the container;

a rotary gas diffusing device for inert gas provided in the container, the rotating movement of the rotary gas diffusing device generating bubbles of inert gas diffused into the nonferrous molten metal stored in the container for removing continuously solid solution gas or nonmetallic inclusions from the nonferrous molten material in the containers;

at least one heater extending from said side wall of said container at a location adjacent the bottom wall substantially parallel with respect to said bottom wall of the container, said at least one heater being configured to be substantially entirely located in the molten metal stored in said container; and a plurality of baffle plates extending substantially vertically along an inner surface of said side wall of said degassing container, said at least one heater being located substantially under the gas diffusing device, which is surrounded by the baffle plates.

2. An inline degassing apparatus according to claim 1, wherein said plurality of baffle plates are arranged so that the baffle plates surround the rotary diffusing device.

3. An inline degassing apparatus according to claim 1, wherein said at least one heater extends in a cantilever fashion from a first portion of the side wall toward a second portion of the side wall opposite the first portion, and said at least one heater has a free end spaced from the opposite inner wall of the side wall of the container at a distance greater than a predetermined value.

4. An inline degassing apparatus according to claim 3, wherein said side wall of the container at said second portion is formed with an outwardly recessed portion for obtaining an increase in the volume of the container at a vertical location corresponding to a supported height of said heater to the side wall of the container.

5. An inline degassing apparatus for a continuous flow of nonferrous molten metal, said apparatus comprising:

an inline degassing container having a side wall and a bottom wall for defining a chamber for storing therein nonferrous molten metal;

an inlet provided on one side of the container for receiving said continuous flow of the nonferrous molten metal into said container for a degassing treatment of the material in the container;

an outlet provided on the other side of the container for discharging the continuous degassed flow of the nonferrous molten material from the container;

a rotary gas diffusing device for inert gas in the container, the rotating movement of the rotary gas diffusing device generating bubbles of inert gas diffused into the nonferrous molten metal stored in the container for removing continuously solid solution gas or nonmetallic inclusions from the nonferrous molten material in the containers;

at least one heater extending in a cantilever fashion from said side wall of said container, so that said at least one heater in the molten metal in the container is located under the rotary gas diffusing device; and a plurality of baffle plates provided on said side wall and projecting from a surface of said side wall toward the rotary gas diffusing device.

6. An inline degassing apparatus according to claim 5, wherein said baffle plates extend integrally and vertically along an inner surface of said side wall of the degassing container.

7. An inline degassing apparatus for a continuous flow of nonferrous molten metal, said apparatus comprising:

an inline degassing container having a side wall and a bottom wall for defining a chamber for storing therein nonferrous molten metal;

an inlet provided on one side of the container for receiving said continuous flow of the nonferrous molten metal into said container for a degassing treatment of the material in the container;

an outlet provided on the other side of the container for discharging the continuous degassed flow of the nonferrous molten material from the container;

a rotary gas diffusing device for inert gas provided in the container, the rotating movement of the rotary gas diffusing device generating bubbles of inert gas diffused into the nonferrous molten metal stored in the container for removing continuously solid solution gas or nonmetallic inclusions from the nonferrous molten material in the containers; and at least one heater extending from said side wall of said container at a location adjacent the bottom wall substantially parallel with respect to said bottom wall of the container, said at least one heater being configured to be substantially entirely located in the molten metal stored in said container, wherein said at least one heater extends in a cantilever fashion from a first portion of the side wall toward a second portion of the side wall opposite the first portion, and said at least one heater has a free end spaced from the opposite inner wall of the side wall of the container at a distance greater than a predetermined value, and wherein said side wall of the container at said second portion is formed with an outwardly recessed portion for obtaining an increase in the volume of the container at a vertical location corresponding to a supported height of said heater to the side wall of the container.

8. An inline degassing apparatus according to claim 7, further comprising a plurality of baffle plates extending substantially vertically along an inner surface of said side wall of said degassing container.

9. An inline degassing apparatus according to claim 8, wherein said plurality of baffle plates are arranged so that the baffle plates surround the rotary diffusing device.

10. An inline degassing apparatus according to claim 9, wherein said at least one heater is located substantially under the gas diffusing device, which is surrounded by the baffle plates.

* * * * *